US011359446B2

(12) United States Patent
Steffenhagen et al.

(10) Patent No.: US 11,359,446 B2
(45) Date of Patent: Jun. 14, 2022

(54) COILED TUBING INJECTOR WITH GRIPPER SHOE CARRIER POSITION MONITOR

(71) Applicant: NOV INTERVENTION AND STIMULATION EQUIPMENT US, LLC, Houston, TX (US)

(72) Inventors: Timothy Scott Steffenhagen, Fort Worth, TX (US); Marcus Joseph Doran, Arlington, TX (US); Kenneth Gene Barnes, Conroe, TX (US)

(73) Assignee: NOV INTERVENTION AND STIMULATION EQUIPMENT US, LLC, Houston, TX (US)

( * ) Notice: Subject to any disclaimer, the term of this patent is extended or adjusted under 35 U.S.C. 154(b) by 0 days.

(21) Appl. No.: 17/309,767

(22) PCT Filed: Dec. 13, 2019

(86) PCT No.: PCT/US2019/066238
§ 371 (c)(1),
(2) Date: Jun. 17, 2021

(87) PCT Pub. No.: WO2020/131621
PCT Pub. Date: Jun. 25, 2020

(65) Prior Publication Data

US 2021/0348459 A1 Nov. 11, 2021

Related U.S. Application Data

(60) Provisional application No. 62/781,992, filed on Dec. 19, 2018.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 4,585,061 A 4/1986 Lyons, Jr. et al.
5,799,731 A 9/1998 Avakov et al.
(Continued)

FOREIGN PATENT DOCUMENTS

CA 3017404 A1 3/2019
GB 2568154 A 5/2019
(Continued)

OTHER PUBLICATIONS

U.S. Appl. No. 16/131,291 U.S. Pat. No. 10,975,634, filed Sep. 14, 2018, Tubing Guide Stabilization.
(Continued)

*Primary Examiner* — Matthew R Buck
(74) *Attorney, Agent, or Firm* — Schwegman Lundberg & Woessner, P.A.

(57) ABSTRACT

A coiled tubing injector system includes a traction system for advancing coiled tubing through the injector and into or out of a well. The traction system includes a plurality of carriers (129) and gripper shoes (128) configured to repeatedly propagate through the injector along guides (114). The traction system also includes a position monitor (134) for monitoring the lateral position of the carrier, gripper shoe, or portion thereof as the carrier and gripper shoe propagates along the coiled tubing path.

21 Claims, 7 Drawing Sheets

(56) References Cited

U.S. PATENT DOCUMENTS

| | | | | |
|---|---|---|---|---|
| 6,216,780 | B1 * | 4/2001 | Goode | B65H 51/14 166/385 |
| 6,681,614 | B1 | 1/2004 | Riffe | |
| 7,036,578 | B2 | 5/2006 | Austbo et al. | |
| 9,464,493 | B2 | 10/2016 | Andreychuk et al. | |
| 10,975,634 | B2 | 4/2021 | Doran et al. | |
| 2004/0211555 | A1 | 10/2004 | Austbo et al. | |
| 2006/0096754 | A1 | 5/2006 | Weightmann | |
| 2006/0163415 | A1 | 7/2006 | Geddes et al. | |
| 2008/0173480 | A1 | 7/2008 | Annaiyappa et al. | |
| 2013/0048270 | A1 | 2/2013 | Havinga et al. | |
| 2014/0000867 | A1 | 1/2014 | Andreychuk et al. | |
| 2014/0174194 | A1 | 6/2014 | Wu | |
| 2015/0101799 | A1 | 4/2015 | Steffenhagen et al. | |
| 2016/0138347 | A1 | 5/2016 | Bjorenak | |
| 2016/0369614 | A1 | 12/2016 | Turner et al. | |
| 2017/0006878 | A1 | 1/2017 | Domenicucci et al. | |
| 2017/0260835 | A1 | 9/2017 | Crawford et al. | |
| 2018/0320502 | A1 | 11/2018 | Turner et al. | |
| 2019/0062068 | A1 | 2/2019 | Kreisfeld et al. | |
| 2019/0085646 | A1 | 3/2019 | Doran et al. | |

FOREIGN PATENT DOCUMENTS

| | | | |
|---|---|---|---|
| SG | 10201808078 | | 4/2019 |
| WO | WO-2009044117 | A1 | 4/2009 |
| WO | WO-2017105411 | A1 | 6/2017 |
| WO | WO-2020060998 | A1 | 3/2020 |
| WO | WO-2020131621 | A1 | 6/2020 |
| WO | WO-2020223502 | A1 | 11/2020 |

OTHER PUBLICATIONS

U.S. Appl. No. 17/250,799, filed Mar. 4, 2021, Injector Remote Tubing Guide Alignment Device.

"U.S. Appl. No. 16/131,291, Examiner Interview Summary dated Sep. 28, 2020", 3 pgs.

"U.S. Appl. No. 16/131,291, Final Office Action dated Aug. 10, 2020", 9 pgs.

"U.S. Appl. No. 16/131,291, Non Final Office Action dated Apr. 6, 2020", 11 pgs.

"U.S. Appl. No. 16/131,291, Notice of Allowance dated Dec. 14, 2020", 6 pgs.

"U.S. Appl. No. 16/131,291, Response filed Jul. 6, 2020 to Non Final Office Action dated Apr. 6, 2020", 10 pgs.

"U.S. Appl. No. 16/131,291, Response filed Nov. 9, 2020 to Final Office Action dated Aug. 10, 2020", 7 pgs.

"International Application Serial No. PCT/US2019/051443, International Preliminary Report on Patentability dated Mar. 25, 2021", 7 pgs.

"International Application Serial No. PCT/US2019/051443, International Search Report dated Nov. 13, 2019", 2 pgs.

"International Application Serial No. PCT/US2019/051443, Written Opinion dated Nov. 13, 2019", 5 pgs.

"International Application Serial No. PCT/US2019/066238, International Search Report dated Mar. 25, 2020", 5 pgs.

"International Application Serial No. PCT/US2019/066238, Written Opinion dated Mar. 25, 2020", 5 pgs.

"International Application Serial No. PCT/US2020/030755, International Preliminary Report on Patentability dated May 18, 2021", 8 pgs.

"International Application Serial No. PCT/US2020/030755, International Search Report dated Aug. 4, 2020", 2 pgs.

"International Application Serial No. PCT/US2020/030755, Written Opinion dated Aug. 4, 2020", 7 pgs.

"United Kingdom Application Serial No. 1815273.6, Response filed Sep. 17, 2019 to Search Report dated Feb. 28, 2019", 21 pgs.

"United Kingdom Application Serial No. 1815273.6, Search Report dated Feb. 28, 2019", 6 pgs.

"European Application Serial No. 19836388.9, Communication Pursuant to Article 94(3) EPC dated Jan. 18, 2022", 4 pgs.

* cited by examiner

COILED TUBING INJECTOR WITH GRIPPER SHOE CARRIER POSITION MONITOR

CLAIM OF PRIORITY

This patent application is a U.S. National Stage Filing under 35 U.S.C. 371 from International Application No. PCT/US2019/066238, filed on Dec. 13, 2019, which claims the benefit of priority to U.S. Application Ser. No. 62/781,992, filed Dec. 19, 2018, each of which are incorporated by reference herein in its entirety.

TECHNOLOGICAL FIELD

The present disclosure relates to coiled tubing units. More particularly, the present disclosure relates to coiled tubing injectors. Still more particularly, the present disclosure relates to devices, systems, and methods for monitoring and/or sensing the position of portions of a traction system of a coiled tubing injector and, in particular, the lateral position of the drive system or chain.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Coiled tubing refers to a continuous string of pipe coiled on a take-up reel for transportation and handling. Coiled tubing is provided with outer diameters ranging from 0.75 inches to 4 inches, and may be used in a wide range of oilfield services and operations throughout the life of a well. A coiled tubing unit may be a mobile or stationary vehicle or structure for performing coiled tubing operations at a well. A coiled tubing unit may often have a coiled tubing injector. The injector may drive or guide the tubing into a well for performing various oilfield services or operations. The coiled tubing unit may additionally have a coiled tubing guide, which may generally direct the tubing, as it is spooled onto or unspooled from a reel and as it exits the injector or enters the injector, respectively. In general, the guide may help to mitigate bends or kinks in the continuous tubing before it is fed into the injector and may be used to control alignment of the tubing as it enters the injector.

As the coiled tubing enters the injector it may be grasped by a traction system including a series of shoes mounted on a chain drive. The traction system may include two halves that may hydraulically adjusted to control the amount of space between the two halves and, as such, control engagement with each side of the coiled tubing. The traction system may, thus, engage the coiled tubing between the two halves creating a friction connection with a surface of the coiled tubing. Each half of the traction system may advance at substantially equal rates to advance the coiled tubing through the injector.

The grasping nature of the traction system may hold the coiled tubing in substantial alignment within a plane generally aligned with the coiled tubing path from the spool, along the coiled tubing guide, and through the injector. However, the traction system may be a chain drive system, which may allow for some play and/or lateral movement in and out of the plane. When this lateral movement becomes excessive, it can be damaging to the injector or the coiled tubing and can result in unexpected stoppages or interruptions. Even small errors or deviations from on-center can lead to excessive component wear. Given the extremely high forces, dirty environment, the several moving parts within the injector, the location deep within the machine, and the small errors or deviations at issue, visual monitoring or inspection during operation is not generally feasible.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, a coiled tubing injector system may include a coiled tubing injector having a traction system therein for receiving and advancing coiled tubing through the injector and into or out of a well. The traction system may include a plurality of carriers or grippers configured to repeatedly propagate through the injector along and adjacent to a coiled tubing path. The traction system may also include a position monitor for monitoring the lateral position of the carrier, gripper, or portion thereof as the carrier or gripper propagates along the coiled tubing path.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to novel and advantageous devices, systems, and methods for monitoring the lateral position of a traction system within a coiled tubing injector. In one or more embodiments, the coiled tubing injector may include switches, sensors, or other monitoring devices for assessing the operation of the traction system within a coiled tubing injector. In particular, the monitoring devices may monitor whether and/or how far out of alignment, the traction system is getting as it advances coiled tubing through the injector. Live readings may indicate that the traction system is out of alignment and/or how far out of alignment the traction system is, which may allow for avoiding damage to the injector, damage to the coiled tubing, and/or breakdowns or other stoppages resulting from the misalignment. Users of the system may monitor the alignment and plan for maintenance to occur at times when the system is not in demand or otherwise not being used.

In some situations, the traction system may begin to run poorly or out of alignment and may wear paths into a guiding skate, which may set the machine up to continue to follow the path and continue to run poorly. The carriers may contact the traction beams or supports or the gripper shoe may scratch the coiled tubing. The deviating traction system may also induce high thrust into the sprockets, which may cause sprocket wear or damaged support bearings. Non-centralized traction loading can cause twisting of the traction system due to imbalance. One or more of the above issues may have a tendency to accelerate over time and get worse.

Figure 1:
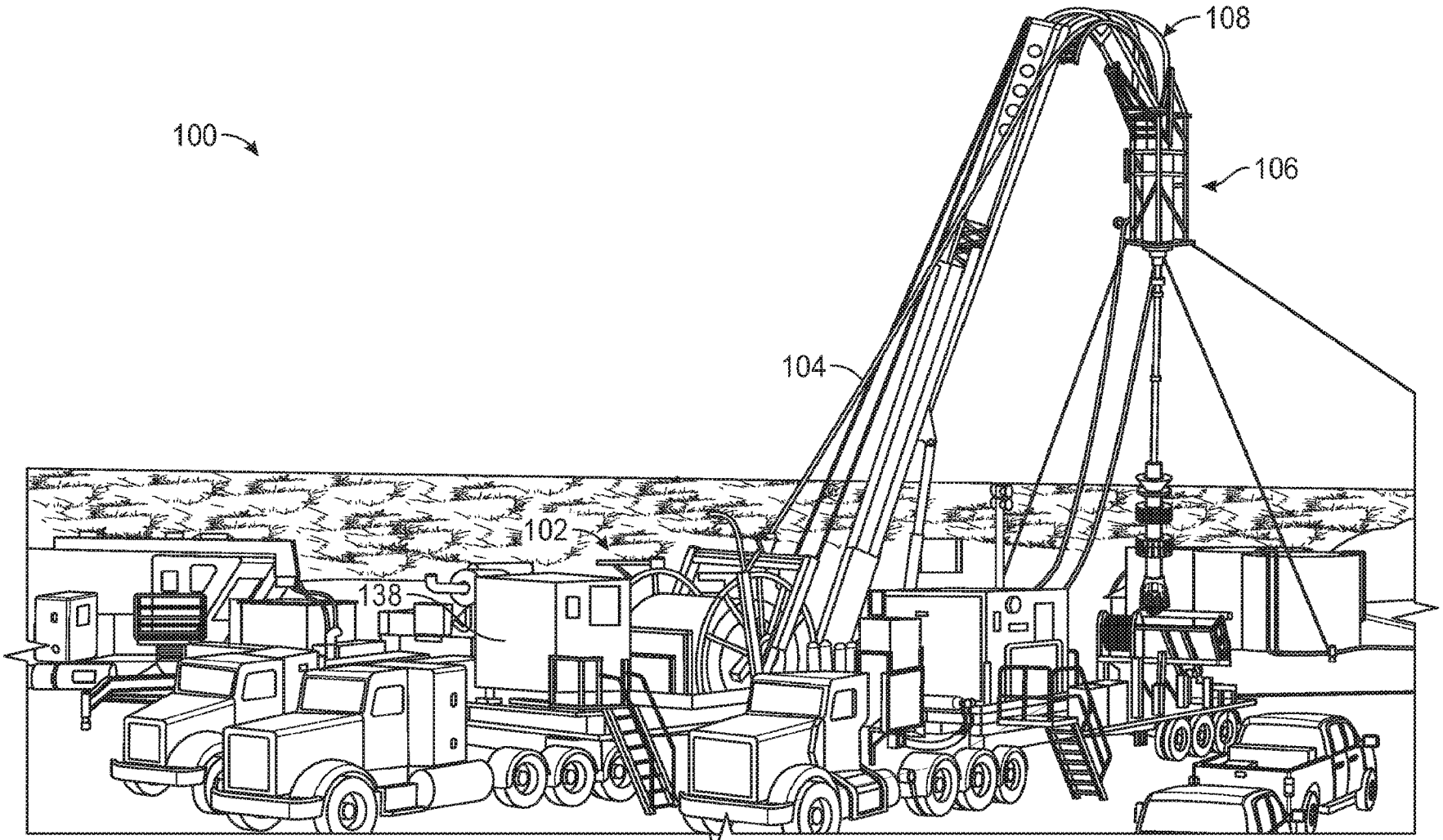
FIG. 1 is a perspective view of a coiled tubing unit in position on a well pad, according to one or more embodiments.

As shown in FIG. 1, a coiled tubing unit 100 may include a tubing spool 102 containing a very high linear footage of coiled tubing 104. The unit 100 may also include a coiled tubing injector 106 for advancing the tubing 104 into a well and a coiled tubing guide 108 for guiding the tubing from the spool and into the injector. In one or more embodiments, the injector and the guide may be supported by a crane and suspended above a well allowing the injector to pull the tubing from the spool and through the guide and advance the tubing into the well. While the coiled tubing may be run off of the spool and may track back and forth across the spool from one side to the other, the spool, the coiled tubing guide, and the injector may all generally define a working plane for the coiled tubing as it leaves the spool, passes across the guide, and through the injector into the well.

Figure 3:
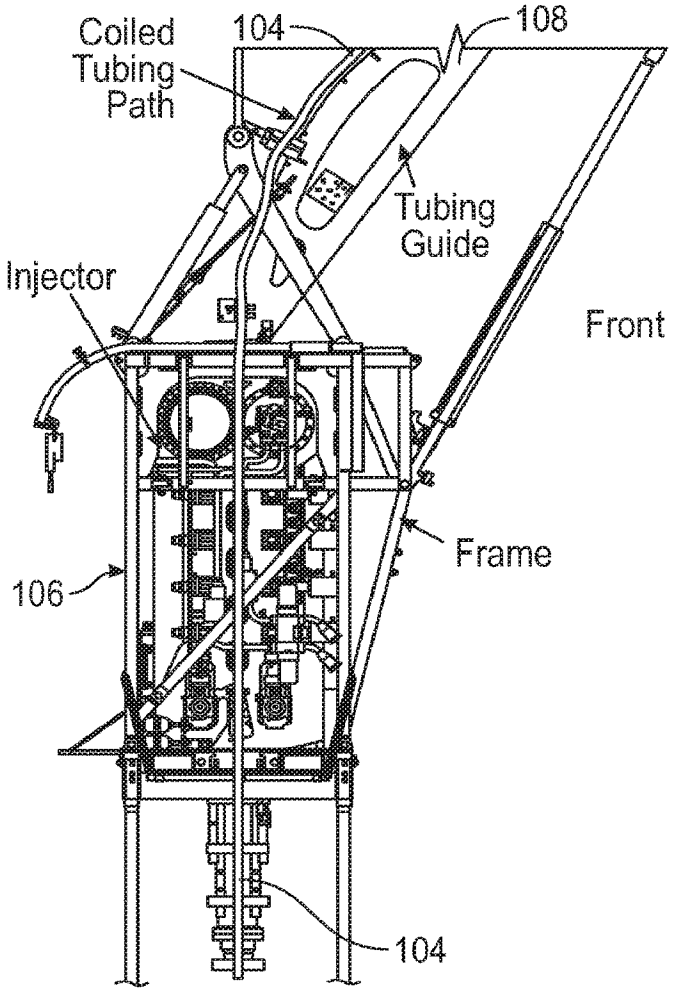
FIG. 3 is a close-up side view of an injector with a coiled tubing passing therethrough, according to one or more embodiments.
Figure 2:
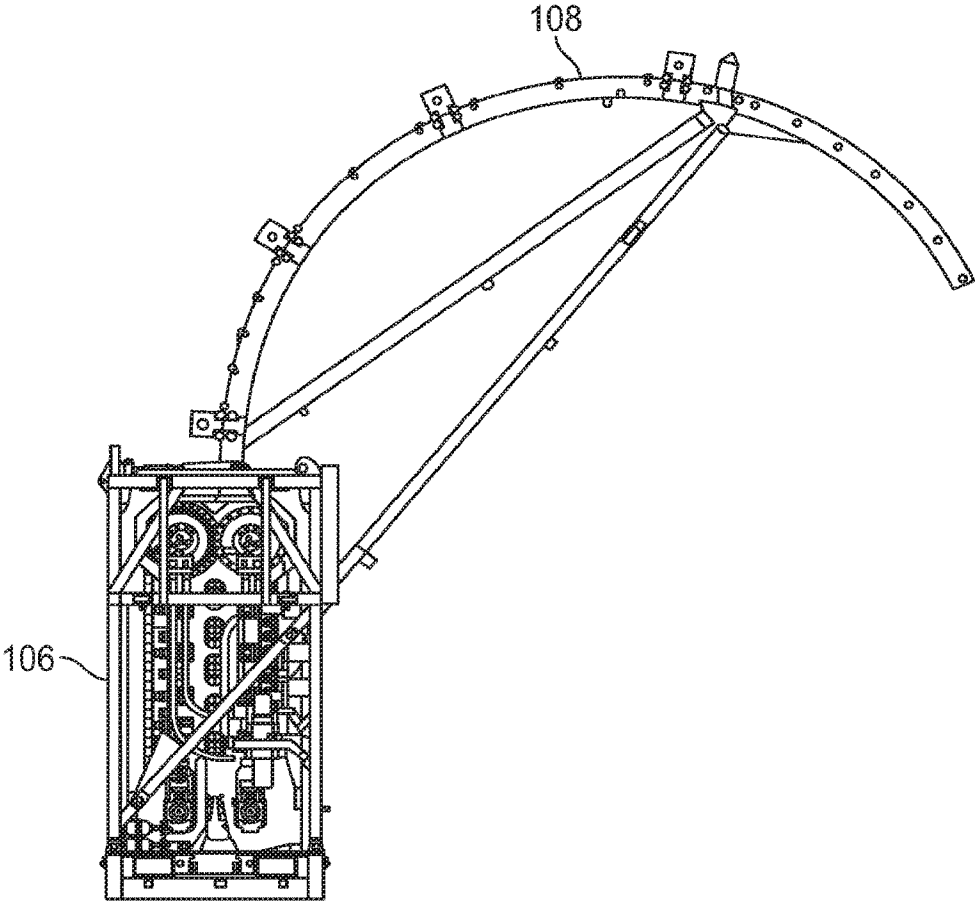
FIG. 2 is a side view of a coiled tubing guide coupled to a coiled tubing injector frame, according to one or more embodiments.
Figure 5:
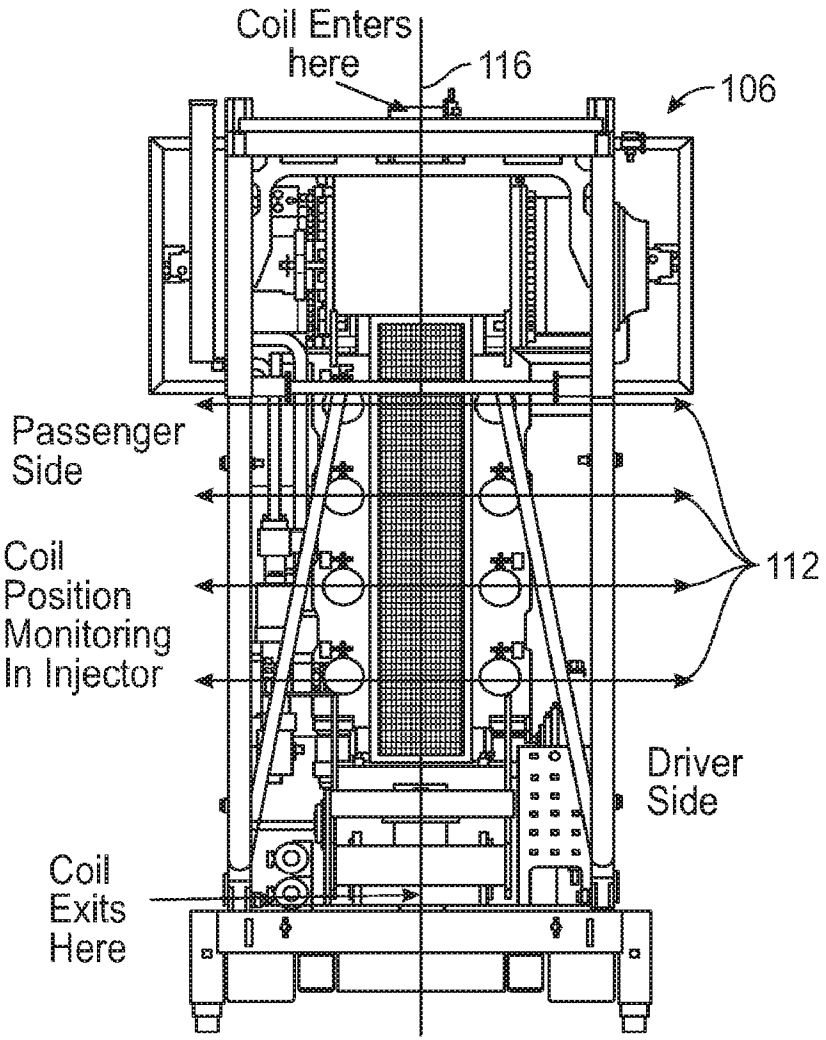
FIG. 5 is a close-up front view of an injector, according to one or more embodiments.

FIG. 2 is a side view of a tubing guide 108 in position on a tubing injector 106. As shown, the tubing guide 108 may be an arcuate structure configured for guiding the tubing 104 off of the spool 102 and into the injector 106. The injector 106 may be arranged within a frame and the tubing guide may be mounted on the frame. As shown in a closer view in FIGS. 3 and 4, the tubing guide may be secured to the frame of the injector so as to align the incoming tubing with a traction system 110 within the injector allowing the traction system to engage and advance the tubing. As shown in FIG. 5, the path of travel of the tubing may define a working plane 116. The spool may be arranged to deliver the tubing at or near the working plane 116 as the tubing tracks back and forth across the spool. The spool may deliver the tubing along the working plane 116 to the tubing guide. The centerline of the tubing guide may fall in the working plane and the path of travel of the tubing through the injector may also fall in the working plane 116.

Figure 4:
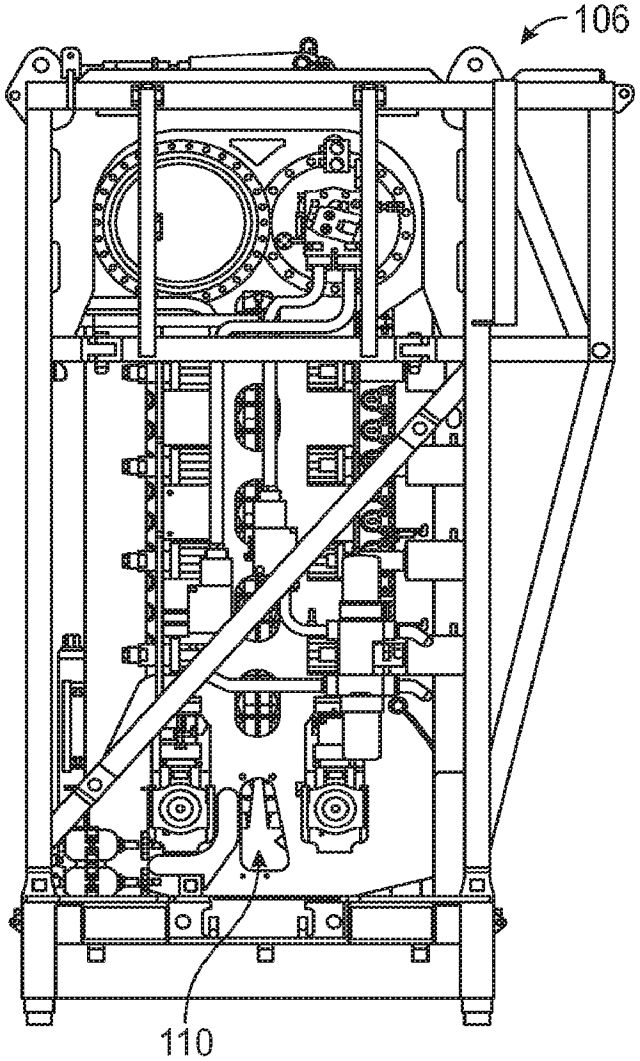
FIG. 4 is a close-up side view of an injector, according to one or more embodiments.

FIG. 4 shows a close up side view of an injector 106. The injector 106 may include an internal traction system 110 for gripping the coiled tubing and drawing or advancing the coiled tubing through the injector. The traction system 110 may include shoes that engage the tubing from each side and move with the tubing through the injector.

FIG. 5 is a front view of the injector 106 (i.e., from the truck side of FIG. 1) where the passenger side of the injector is on the left and the driver side of the injector is on the right. The present system may include sensors or other devices for monitoring the lateral position 112 (i.e., transverse to the working plane) of the coiled tubing at one or more locations along the path of travel through the injector.

Figure 7:
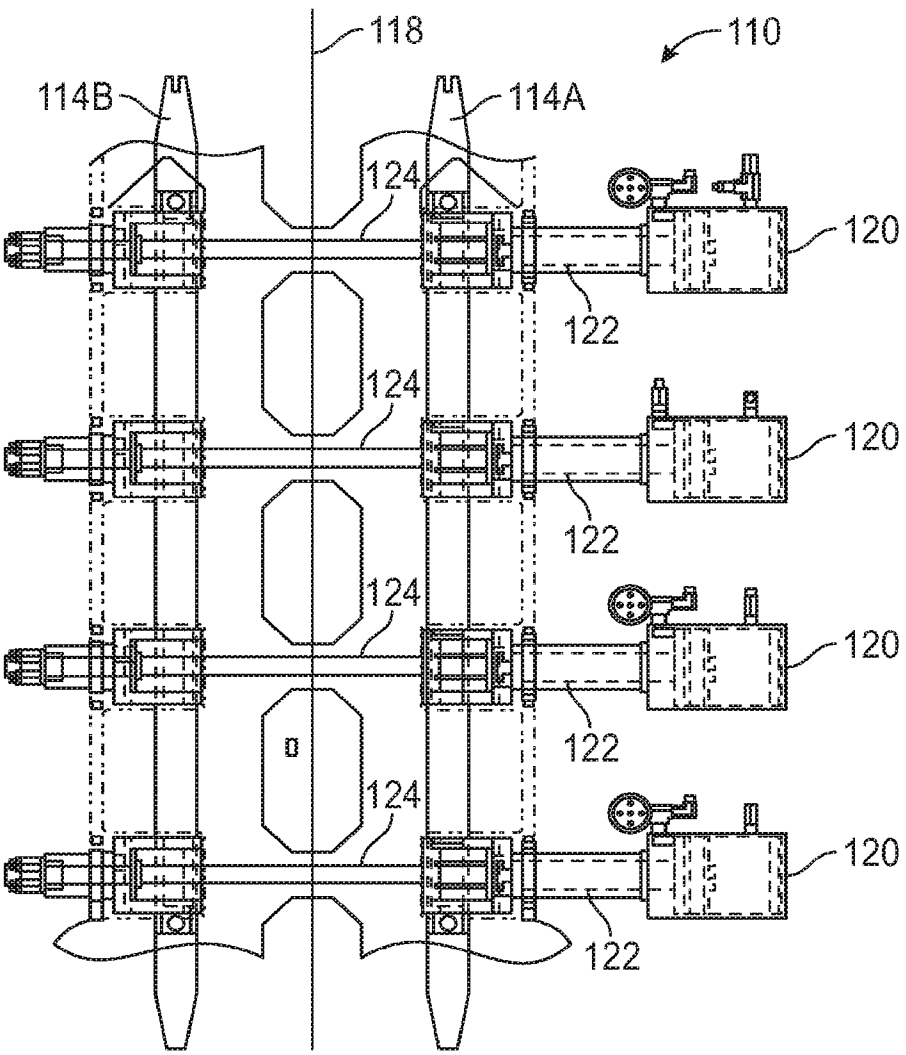
FIG. 7 is a side view of a traction system, according to one or more embodiments.
Figure 6:
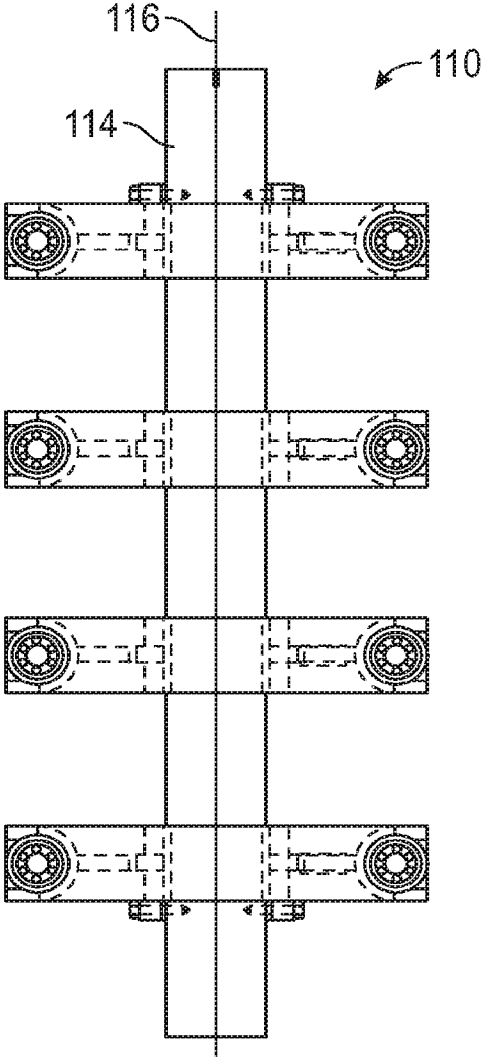
FIG. 6 is a front view of a traction system, according to one or more embodiments.

FIG. 6 shows an internal front view of the traction system 110 of the injector 106. That is, several portions of the injector have been removed or omitted to reveal a portion of the traction system called a skate, track, or vertically extending guide 114. The traction system 110 may include a vertically extending guide 114 on either side of the coiled tubing. The guide 114 may be configured for rolling or sliding engagement by a moving portion of the traction system 110 and for controlling the width of the traction system 110. That is, one or both guides on each side of the traction system may be adjustable to increase or decrease the space between them to cause the shoes to suitably engage the coiled tubing. As shown in FIG. 7, the guides may be mounted on opposing sides of the coiled tubing path 118 and may be adjustable by one or more hydraulic cylinders, screw drives, or other telescoping or other longitudinally adjustable actuation devices 120. A first guide 114A may be held in position by a collar or standoff 122 defining a distance from the actuation device 120 to the first guide 114A. The second guide 114B may be on an opposite side of the tubing path 118 and may have an adjustable position based on a rod 124 extending or retracting from the actuation device 120. A top down view of the system may be seen in FIG. 8. As shown, the guides 114A/B on each side of the tubing path 118 may be arranged on a beam 126, which spans between a pair of rods 124 extending from respective actuation devices 120. The extension or retraction of the rods 124 by the actuation devices 120 may move the beams 126 further away from or closer to each other and, accordingly, move the guides further away from or closer to each other. In this manner, the amount of clamping force of the traction system 110 on the tubing 104 may be adjusted or controlled.

Figure 8:
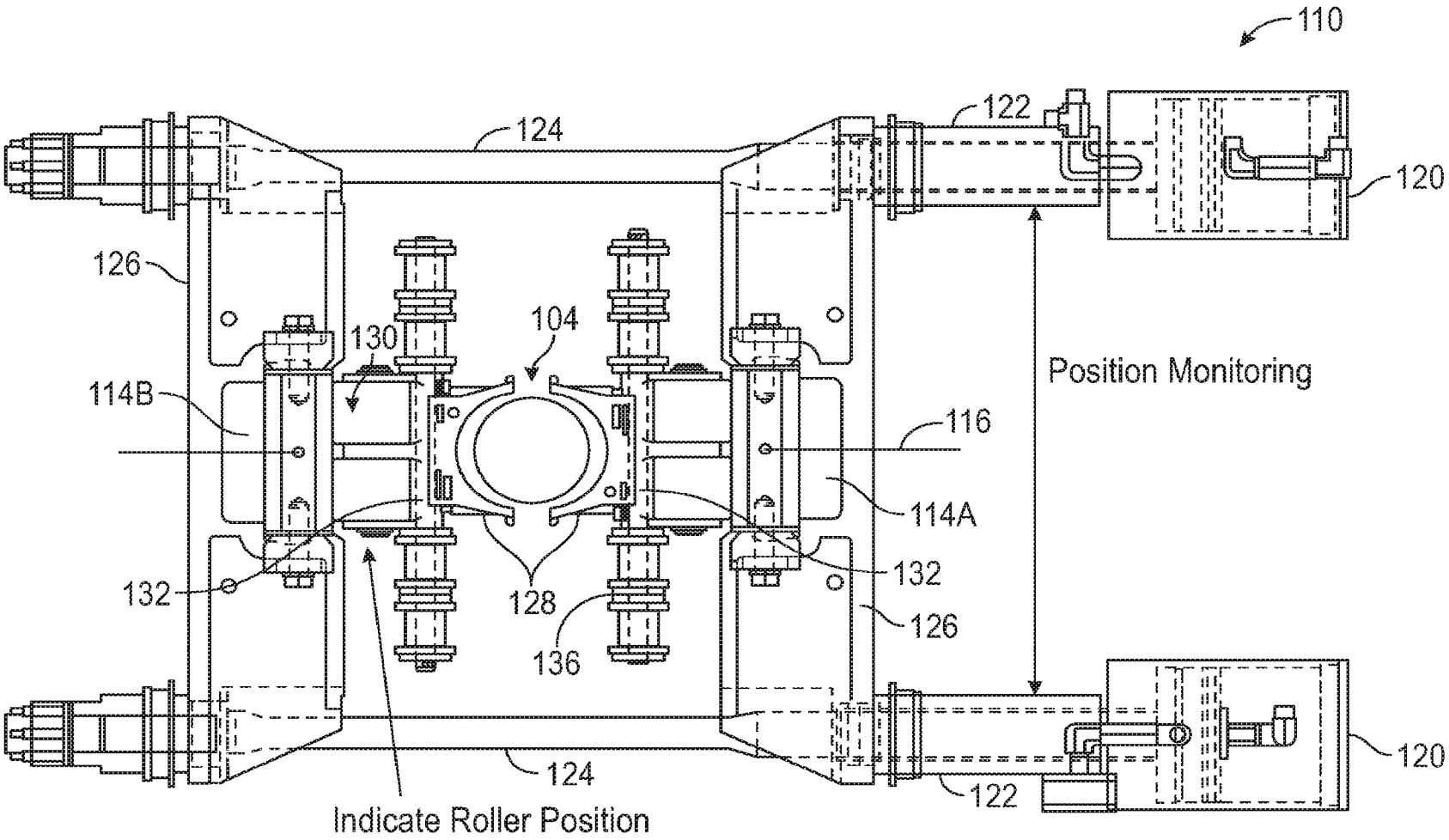
FIG. 8 is a top down view of a traction system, according to one or more embodiments.

With continued reference to FIG. 8, the traction system may include a plurality of carriers 129 adapted for secured engagement along a chain, belt, or other drive mechanism. For example, the carriers 129 may be secured to a link of a chain or a joint between links of a chain. The carriers 129 may allow for the interfacing with the guides 114 and the coiled tubing by including a shoe or shoes 128 on one side for engaging the coiled tubing and rollers or track followers 130 on an opposing side for engaging the guides 114. The shoes 128 may have a concave or trough shape when viewed from above and the surface of the shoes 128 may have a radiused contour adapted for engaging the radiused outer wall of the coiled tubing 104. The shoes 128 may include or be mounted to the carrier. As mentioned the carrier may also include roller bearings, rollers, slides, skids, or other track followers 130 adapted to follow the guides 114. The adjustable guides may be used to press the track followers 130, carriers 129, and shoes 128 against the tubing from each side thereby gripping the tubing and advancing it through the injector 106.

The carriers 129 on each side of the tubing path 118 may be substantially equally spaced along a drive system 136, such as a drive chain or drive belt, configured for moving them through the injector at a selected rate. In one more embodiments, the carriers may not be equally spaced. The drive system may be a substantially continuous drive chain or belt that passes across a drive gear or pulley at a top and/or bottom of the injector and across a gear or pulley at an opposite end of the injector. As shown in FIG. 8, the carriers 129 may be mounted to the drive system 136 with one or more mounting rods 132 configured for engaging the drive system on each side thereof.

As may be appreciated and in the case of the drive system being a drive chain, the chain may include a plurality of links connected to one another at pins and the chain may be adapted to engage the gears at the top and bottom of the injector where the teeth of the gears engage the links of the chain between the pins and force the chain to travel at a rate substantially similar to the speed of the perimeter of the gears. As may also be appreciated, the chain may have some amount of play in the lateral direction. That is, the connections between the pins and links may allow the links to rotate relatively freely about the axis of the pins, but rotation of the links about an axis perpendicular to the pins may be generally prevented. However, due to imperfect connections between the links and pins (i.e., flexible bushings/bearings, etc.) each link may have some ability to rotated about an axis perpendicular to the pins. As the chain extends from a gear at the top of the injector to a gear at the bottom of the injector, various amounts of play between each of the links and the pins may accumulate and may provide for a fairly large amount of potential lateral movement of the chain, particularly near the mid-height of the injector.

Figure 9:
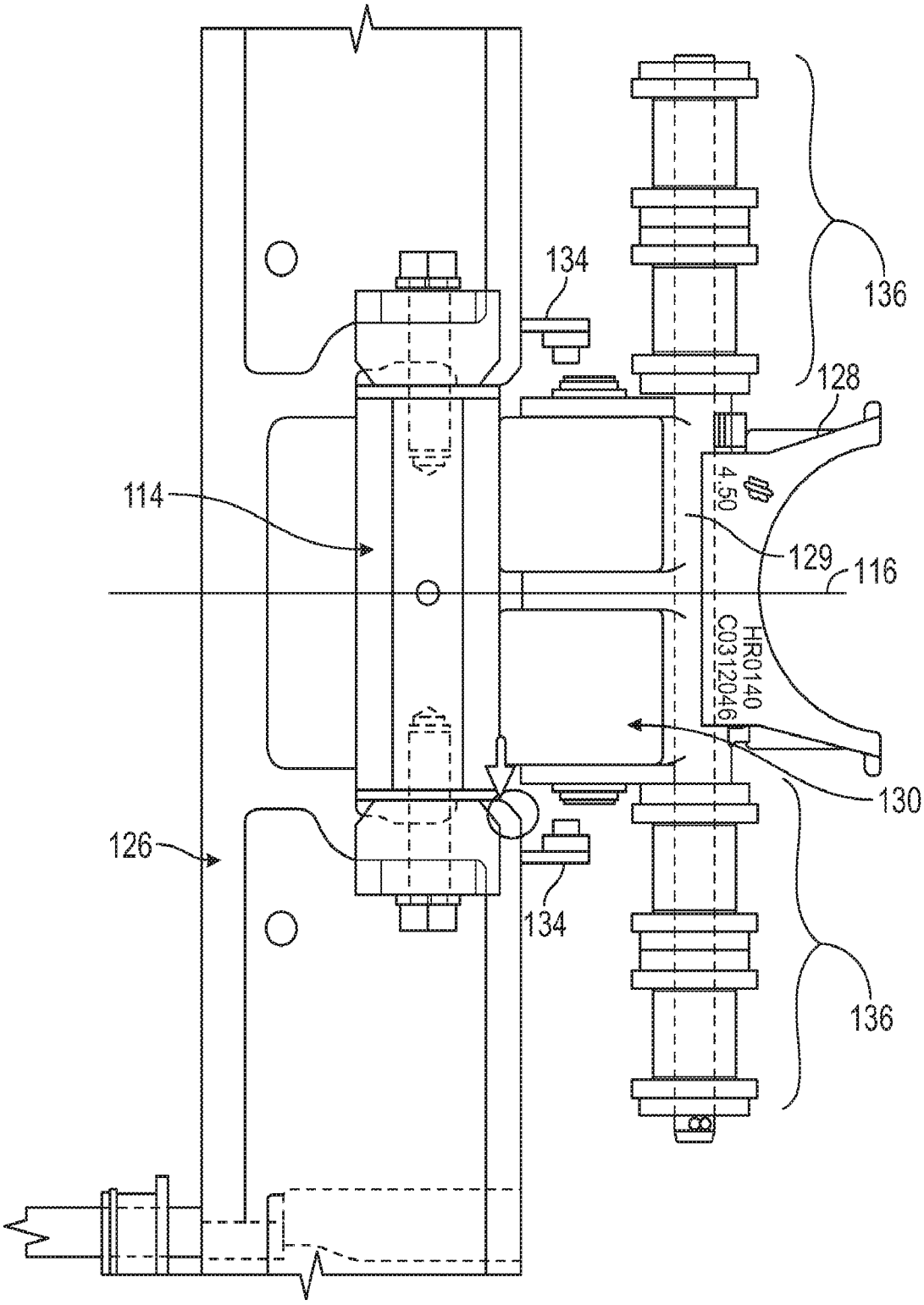
FIG. 9 is a close-up top down view of one side of the traction system with a position monitor, according to one or more embodiments.

FIG. 9 shows a close-up view of a carrier 129 and shoe 128 on the injector 106 and its associated roller or other track follower 130 riding along the guide or skate 114. Due to the play in the chain just discussed and other factors, the carriers 129 may have a tendency to drift side to side across the width of the guide or skate 114. That is, the carriers 129 may drift in a lateral direction 112 substantially perpendicular to the working plane 116 mentioned. If the carriers drift too far across the surface of the guide or skate, the carriers may engage portions of the beam or other portions of the traction mechanism or may rub, wear, or collide with other internal aspects of the injector. Accordingly, it is helpful to have a way to actively determine the position of the carrier relative to the skate to assess the suitability of continued operation and to plan for maintenance or adjustments throughout the life of the injector.

In one or more embodiments, a position monitor 134 may be provided to assess the position of the roller and/or carrier across the width of the skate. The position monitor may include a mechanical type sensor such as a bump stop or bump sensor. Alternatively or additionally, the sensor may include a magnetic field sensor, a vibration sensor, an acoustic sensor or another sensor non-mechanical sensor adapted to assess the position of the roller or carrier across the width of the skate. In one or more embodiments, the sensor may be adapted to interrupt operations, for example when the lateral position of the roller or carrier has veered too drastically across the width of the skate. Additionally or alternatively, the sensor may be adapted to determine the absolute or relative position of the roller or carrier across the width of the skate. It is to be appreciated that one or a plurality of position monitors may be provided throughout the height of the injector along the skate and that position monitors may be provided on each side of the traction system or in association with each skate, for example. As such, the lateral position of the drive system at several points throughout the height of the injector may be determined as the drive system passes through the injector.

As shown, a mechanical position monitor 134 is shown in the form of a bump stop or bump sensor. As shown, the bump stop or bump sensor may be arranged in a position to generally remain free from contact with the traveling carrier. In one or more embodiments, the bump sensor may be arranged on an internal surface of the beam between the chain and the beam and adjacent the skate. The bump sensor may have a contact facing laterally away from the bump sensor that is adapted to engage the roller, carrier, or portion thereof if the carrier veers too far laterally across the surface of the skate. The bump sensor may include two bump sensors, one on each lateral side of the skate allowing for detection if the carrier travels too far in either direction. In one or more embodiments, the bump sensor may be configured for one or more degrees of engagement with the roller or carrier. For example, a depressible pin, button, lever, or other actuatable element may create a notification if the roller or carrier slightly brushes the actuatable element and may create a more serious notification if the roller or carrier causes further actuation of the actuatable element. In one or more embodiments, if the actuatable element is fully or substantially fully actuated or depressed, the bump sensor may cause machine interruption. In one or more embodiments, the bump sensor may include a hydraulic sensor. The hydraulic sensor may be a pressure-type sensor that causes a change in pressure in a hydraulic system when bumped or pressed. In one or more embodiments, the amount of depression of a bump sensor may increase the pressure based on how much the sensor is depressed allowing for a range of sensing. Alternatively, or additionally, the bump sensor may include an electrical sensor that may be triggered by creating contact with electrical sensors or changing a magnetic or electrical field allowing the bump sensor to sense a range of interference and, thus, an amount of deviation in the lateral direction, for example.

Figure 10:
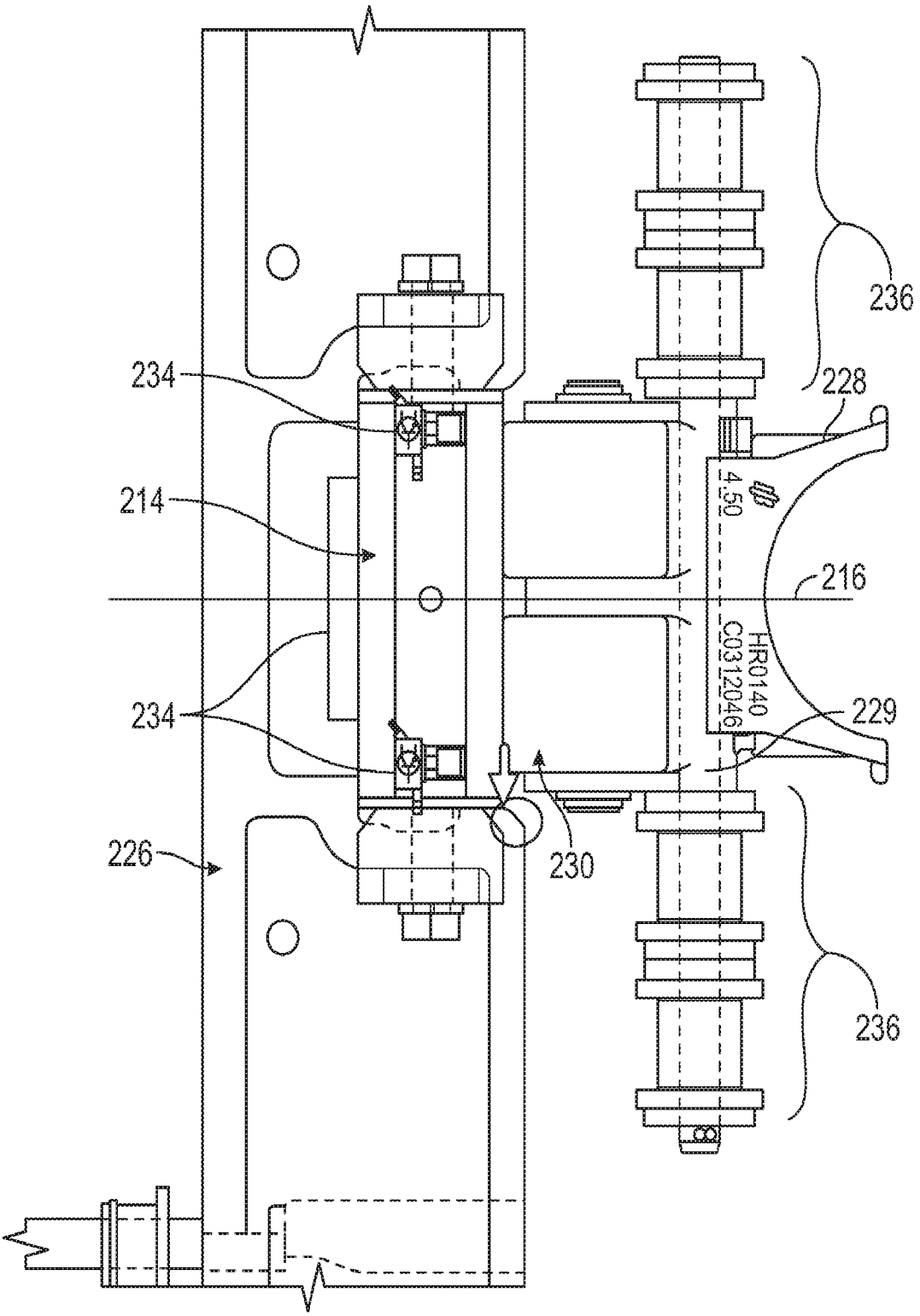
FIG. 10 is a close-up top down view of one side of the traction system with a position monitor, according to one or more embodiments.

Referring to FIG. 10, non-mechanical position monitor 234 is shown. For example, the position monitor 234 may include a magnetic-type sensor, a vibration sensor, or an acoustic sensor for sensing the motion of carriers within the traction system. The sensor may be installed into the skate and may be adapted for detecting the moving carrier. In the case of a magnetic sensor, a carrier moving passed the sensor in the skate may alter or otherwise disrupt a magnetic field or voltage within the sensor. In one more embodiments, the strength or magnitude of the alteration of the magnetic field or voltage may be used to determine the location of the roller on the skate.

In one or more embodiments, a hall effect sensor may be used. The hall effect sensor may be positioned within the skate and may include 3 conductive connections such as a ground, a reference voltage, and a signal terminal. The sensor may include a two pole magnet arranged such that the poles of the magnet are along a line extending laterally and a hall plate or band may be arranged between the magnet and the surface of the skate. This arrangement may allow the sensor to pick up the presence of a roller of a carrier as it passes by the sensor along the surface of the skate due to the voltage induced in the hall plate or band as the roller passes by. One or more sensors may be provided across the width of the skate to determine the presence of the rollers. In one or more embodiments, a single hall effect sensor may be provided on each outer edge of the skate at or near each of the beams throughout the height of the skate. In other embodiments, several sensors may be provided across the width of the skate and at one or more of the beams throughout the height of the injector. In either case, the varying effect on the several sensors of the passing rollers may allow for determinations of the lateral position of the carrier. For example, indications by the outer more positioned sensors as compared to the indications of the sensors on the opposite side of the skate may provide an indication of the amount of lateral movement of the carriers. In one or more embodiments, the hall effect sensor may be installed by substituting the sensor or sensors for the bolt holding the skate to the beam, for example. That is, a substitute bolt may be provided that has one or more hall effect sensors integrated therein.

In still other embodiments, the magnetic-type sensor may be an inductive sensor. Numbers and arrangements of the inductive type sensors may be provided that are similar to the numbers and arrangements described for the hall effect sensors.

In conjunction with one or more of the above magnetic type sensors, other aspects of the injector may be the same or similar to those previously described and, as such, the injector may include a beam 226, a guide 214, a shoe 228, a track follower 230, a drive system 236 and the coiled tubing may travel generally along a working plane 216.

Yet another type of non-mechanical position monitor 234 may be a vibration sensing element. The vibration sensing element may be arranged on the skate and may interpret vibrations patterns to determine the position of the carriers relative to the width of the skate.

In one or more embodiments, the sensor 234 may be an acoustic sensor that may be used to listen for echo through the air and identify the location of the carrier or other aspects of the traction system across the skate. Alternatively, or additionally, the acoustic sensor may be a microphone type sensor on the skate that may listen for pitch and/or volume differences across the skate. As with the magnetic type sensor described, one, two, or a series of acoustic sensors may be provided across the width of the skate and throughout the height of the skate. Also, such sensors may be provided by using a replacement bolt and, for example, integrating the sensors into the bolt holding the skate to the beam. Other aspects of the injector may be the same or similar to those previously described and, as such, the injector may include a beam 226, a guide 214, a shoe 228, a track follower 230, a drive system 236 and the coiled tubing may travel generally along a working plane 216.

In still other embodiments, a combination of sensors including bump sensors, magnetic sensors, vibration sensors, acoustic sensors, or other sensors may be used to assess the position of the traction system through the injector.

A computing device 138 such as a data collection and interpretation device may be used to monitor the sensors. The system may, thus, display results including the absolute and/or relative position of the carrier as compared to the width of the skate or as compared to a starting or original position for example. The display may include varying degrees of indications including location indicators, warning indicators when the lateral position exceeds a desired wear position, and high alert indicators when the lateral position is such that damage to the injector or the tubing is likely or a high risk. In one or more embodiments, the display may include a vertical screen including a diagram of the several rollers as they pass through the injector and including a variance from a centerline or another measurement. This display may allow for visualizing the patterns of the carrier path as the carriers pass downward along the skate and may allow for a better understanding of the causes of the lateral motion. In one or more embodiments, the data collection and interpretation device 138 may be in wired communication with the one or more sensors or a wireless communication system may be used.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A coiled tubing injector system, comprising:

a coiled tubing injector having a traction system therein for receiving and advancing coiled tubing through the injector and into or out of a well, the traction system comprising:

a plurality of carriers configured to repeatedly propagate through the injector along and adjacent to a coiled tubing path; and a position monitor for monitoring a lateral position of the plurality of carriers or portion thereof relative to a working plane as the plurality of carriers propagate along the coiled tubing path.

2. The coiled tubing injector system of claim 1, wherein the traction system further comprises a guide and the plurality of carriers include track followers for engaging the guide.

3. The coiled tubing injector system of claim 2, wherein the position monitor monitors the position of the track followers across a width of the guide.

4. The coiled tubing injector system of claim 3, wherein the position monitor includes a switch indicator.

5. The coiled tubing injector system of claim 4, wherein the switch indicator is a bump sensor.

6. The coiled tubing injector system of claim 3, wherein the position monitor is a magnetic sensor.

7. The coiled tubing injector system of claim 3, wherein the position monitor is a vibration sensor.

8. The coiled tubing injector system of claim 3, wherein the position monitor is an acoustic sensor.

9. The coiled tubing injector system of claim 1, wherein the traction system comprises a first skate and a second skate, each arranged on either side of the coiled tubing path.

10. The coiled tubing injector system of claim 9, wherein the plurality of carriers include rollers configured for rollably engaging one of the first and second skates and the position monitor includes a first position monitor for the first skate and a second position monitor for the second skate.

11. The coiled tubing injector system of claim 10, wherein the first and second position monitors each include a plurality of position monitors along the length of their respective skates.

12. The coiled tubing injector system of claim 1, further comprising a computing device for collecting and interpreting information from the position monitor.

13. The coiled tubing injector system of claim 12, wherein the computing device includes a display for showing the user information about the lateral position of the plurality of carriers in the injector.

14. The coiled tubing injector system of claim 13, wherein the display includes increasingly serious levels of alerts.

15. The coiled tubing injector system of claim 14, further comprising a spool for feeding coiled tubing to the injector.

16. The coiled tubing injector system of claim 15, further comprising a tubing guide for guiding the coiled tubing from the spool to the injector.

17. The coiled tubing injector system of claim 2, wherein the guide comprises a first guide on a first side of the coiled tubing path and a second guide on an opposing side of the coiled tubing path.

18. The coiled tubing injector system of claim 17, wherein the first guide is held in a substantially fixed position and the second guide is adjustable relative to the first guide.

19. The coiled tubing injector system of claim 18, wherein the second guide is adjustable with an actuation element.

20. The coiled tubing injector system of claim 19, wherein the actuation element is a hydraulic cylinder.

21. The coiled tubing injector system of claim 20, wherein the cylinder comprises a pair of cylinders and a pair of rods straddling the coiled tubing path for adjusting the second guide.

* * * * *